United States Patent [19]

Reubens et al.

[11] 3,965,654

[45] June 29, 1976

[54] BAGGING APPARATUS

[75] Inventors: Clarence Edmond Reubens, Decatur; Sterrett Paxton Campbell; Lloyd Everett Marston, both of Atlanta, all of Ga.

[73] Assignee: Paramount Packaging Corporation, Chalfont, Pa.

[22] Filed: July 21, 1975

[21] Appl. No.: 597,848

[52] U.S. Cl. ..... 53/189; 53/385

[51] Int. Cl.[2] ..... B65B 43/36

[58] Field of Search ..... 53/189, 385

[56] References Cited

UNITED STATES PATENTS

| | | | |
|---|---|---|---|
| 3,440,801 | 4/1969 | Prince et al. | 53/189 |
| 3,508,379 | 4/1970 | Noyes et al. | 53/189 |

*Primary Examiner*—Travis S. McGehee
*Attorney, Agent, or Firm*—Seidel, Gonda & Goldhammer

[57] ABSTRACT

Bagging apparatus includes first and second horns at least one of which is movable. A carriage for supporting a stack of bags is reciprocable toward and away from a loading position wherein the carriage is beneath the horns and the uppermost bag on the carriage is telescoped over the horns. Then said one horn is movable to stretch the bag at its mouth so that an article may be inserted into the bag. Pneumatic circuitry is provided to cause the movable horn and carriage to be automatically cycled in a predetermined manner. As the carriage moves toward the loading position, an air jet causes the uppermost bag on the stack to be opened.

12 Claims, 6 Drawing Figures

BAGGING APPARATUS

BACKGROUND

A wide variety of apparatus for bagging articles has been proposed heretofore. Such apparatus is generally classified in class 53. Exemplary of the prior art, see U.S. Pat. Nos. 3,228,173; 3,412,522; and 3,552,090.

The prior art bagging apparatus is not readily adaptable for bagging food products since the apparatus is not constructed in a manner acceptable to governmental agencies such as the Department of Agriculture. The prior art is either too complex or not otherwise constructed in a manner whereby it may be easily cleaned and maintained sanitary in accordance with such requirements from a sanitary viewpoint. The prior art devices move the product to be bagged by a conveyor while supporting the stack of bags on a support which is limited to movement in an up and down direction, or otherwise are not readily adaptable for use in bagging food products such as frozen chickens. Some prior art bagging apparatus unnecessarily requires excess personnel or are complex so as to require substantial maintenance.

The bagging apparatus of the present invention includes a support structure on which is mounted first and second horns. The second horn is shorter than the first horn. A means is connected to the second horn for moving the second horn toward and away from the first horn. A carriage is supported on the support structure for movement toward and away from the horns.

The carriage is disposed below said horns at one end of its movement. The carriage is provided with means for supporting a stack of bags and for elevating the stack of bags as the bags are filled. Means including circuitry is connected to the second horn and the carriage for automatically cycling the same so that the carriage movement toward the horns causes the top bag to telescope over a portion of the horns as said carriage reaches said one end of its movement and then causes the second horn to move away from the first horn to thereby stretch the mouth of the uppermost bag. A means provided for causing the uppermost bag to open during the movement of the carriage toward the horns.

The apparatus of the present invention as described above is particularly adapted for bagging irregularly shaped food products such as frozen turkeys, hams, or other bulbous irregularly shaped products which are difficult to bag. The apparatus is preferably constructed in a manner so as to be simple for ease of maintenance while at the same time is made from stainless steel so that it may be easily cleaned and comply with sanitary requirements.

It is an object of the present invention to provide a bagging apparatus structurally interrelated to a novel manner adapted to facilitate bagging irregularly shaped objects.

It is another object of the present invention to provide bagging apparatus for bagging bulbous shaped food products in polymeric plastic bags while being structurally interrelated in a manner acceptable to governmental agencies with respect to packaging of food products.

Other objects will appear hereinafter.

For the purpose of illustrating the invention, there is shown in the drawings a form which is presently preferred, it being understood, however, that this invention is not limited to the precise arrangements and instrumentalities shown.

Figure 1:
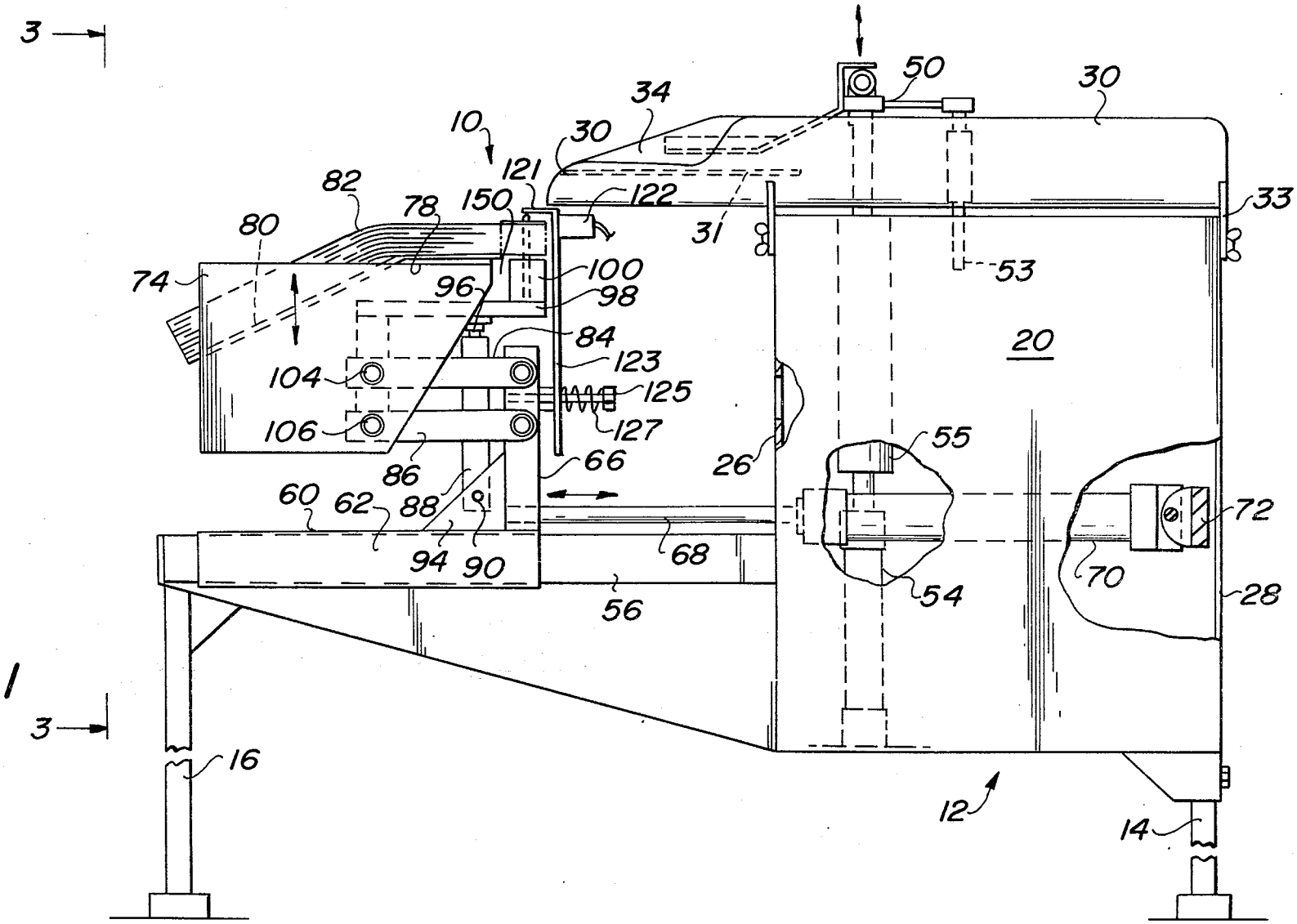
FIG. 1 is a side elevation view of apparatus in accordance with the present invention.

Referring to the drawing in detail, wherein like numerals indicate like elements, there is shown in FIG. 1 bagging apparatus in accordance with the present invention designated generally as 10. The apparatus 10 includes support structure in the form of a housing 12 and frame mounted on a pair of rear legs 14 and front legs 16, 18.

The housing 12 includes vertically disposed side walls 20 and 22 connected together at their upper ends by a top wall 24 and across vertically disposed side edge portions by a front wall 26. The other vertically disposed edge portions are connected together by a vertically disposed rear wall 28.

Figure 3:
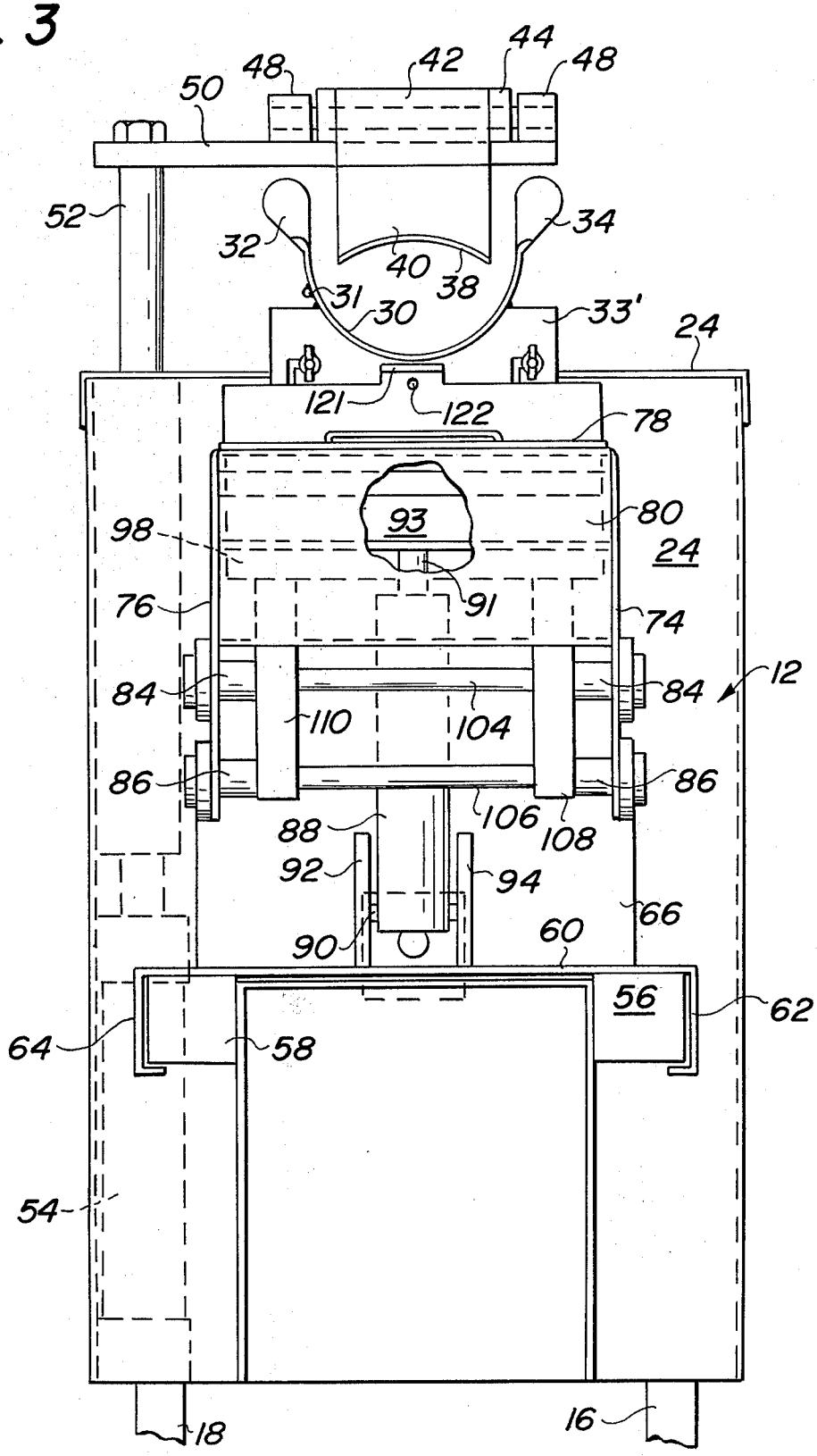
FIG. 3 is a view taken along the line 3—3 in FIG. 1 with the bags being absent.
Figure 4:
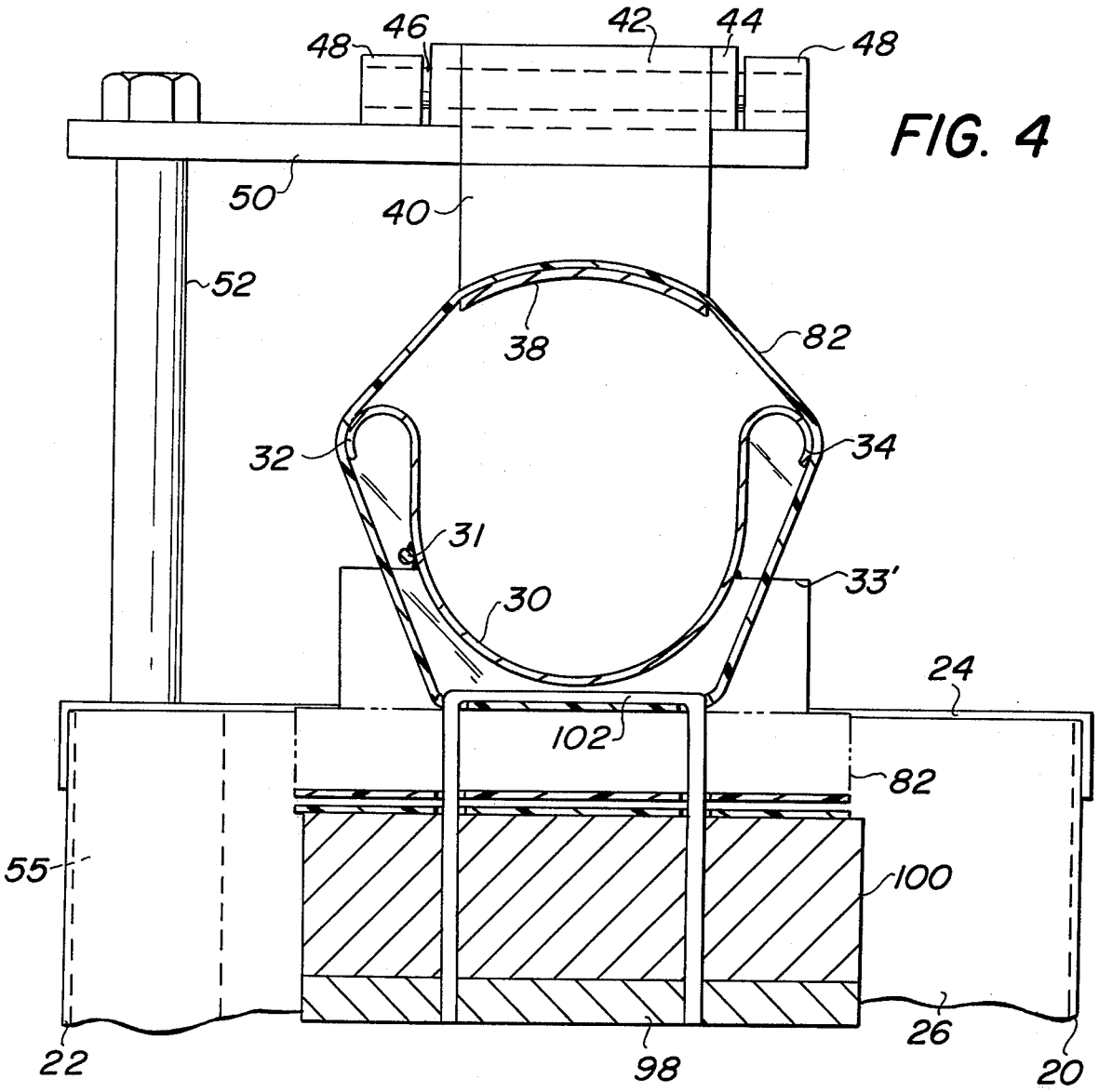
FIG. 4 is a sectional view taken along the line 4—4 in FIG. 2.
Figure 5:
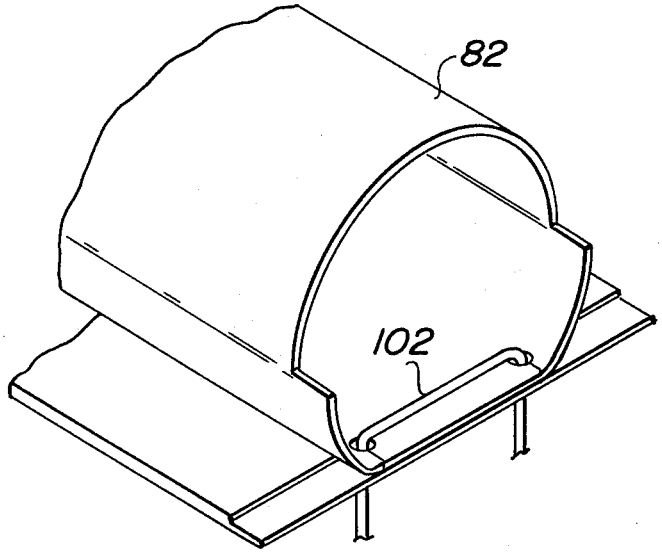
FIG. 5 is a perspective view of a stack of bags with the uppermost bag being open.

First and second horns are supported by the top wall 24. The first horn is designated as 30. Horn 30 has a length so that it projects forwardly beyond the front wall 26 as shown more clearly in FIG. 1. As shown in FIGS. 3 and 4, the horn 30 is generally semicircular with an open top. The leading end or nose portion of the horn 30 is provided with curled angularly disposed edge portions 32 and 34. The upper surface on edge portions 32 and 34 is inclined upwardly as shown in FIG. 1.

See FIG. 3. A removable mounting plate 33 depends from a rear end portion of horn 30. Plate 33 has bayonet slots for receiving bolts on rear wall 28. A similar mounting plate 33' is removably bolted to front wall 26. When wing nuts are removed, the horn 30 may be removed to facilitate cleaning or sterilizing. The outer periphery of horn 30 has an air vent rod or tube 31.

The second horn is designated as 36 and includes a generally horizontally disposed portion 38 and an upwardly inclined or angled portion 40. Portion 38 is concave downwardly as shown more clearly in FIG. 3. The upper end of portion 40 is connected to an L-shaped portion 42. Portion 42 is fixedly secured, such as by welding, to a sleeve 44. Sleeve 44 is rotatably supported for rotation only in an upward direction by a rod 46. A bearing 48 supports each end of rod 46. The bearings 48 are supported by a horizontally disposed arm 50. See FIGS. 2 and 3.

One end of arm 50 is removably bolted to the upper end of a vertically disposed piston rod 52. To prevent rotation of arm 50 about the axis of rod 52, arm 50 has a guide rod 53 parallel to rod 52 and which cooperates with a similarly shaped sleeve on housing 12. The piston rod 52 is connected to a piston within a cylinder 54. The cylinder 54 is disposed within the housing 12. Vertical reciprocation of the piston rod 52 causes the horn 36 to move toward and away from the horn 30. Compare the positions of the horns 30 and 36 as shown in FIG. 3 which is the bag receiving position with the position shown in FIG. 4 which is the bag filling position.

The housing 12 includes a narrow forwardly projecting frame defining carriage tracks 56 and 58 which are horizontally disposed and project from right to left in FIG. 1 from the front wall 26. A carriage is reciprocably supported by the tracks 56 and 58 for movement toward and away from the front wall 26. The carriage is disposed at an elevation so that it will be beneath the horn 30 when adjacent to the wall 26.

The carriage includes a base 60 having angle edge portions 62 and 64 which embrace top, bottom and side edges of the tracks 56, 58. See FIG. 3. The base includes a vertically disposed portion 66 extending upwardly from the base 60.

A pneumatic means is provided for causing the carriage to reciprocate toward and away from the front wall 26. Such means includes a piston rod 68 having one end connected to the vertically disposed portion 66. The other end of the piston rod 68 is connected to a piston disposed within the cylinder 70. Cylinder 70 is disposed within the housing 12 and has one end connected thereto by a clevice 72 whereby said one end of the cylinder 70 may pivot about a horizontal axis.

The carriage supports a device for elevating a stack of bags as the bags are filled and thereby consumed. Thus, the carriage supports a pair of upright side plates 74 and 76 having a horizontal wall 78 across the end thereof at the upper end portion adjacent wall 26. The plates 74 and 76 are also provided with an angled wall 80 extending downwardly away from the horn 30. See FIGS. 1 and 2. The walls 78 and 80 support a stack of bags 82.

Each of the plates 74 and 76 is connected to the vertically disposed portion 66 of the carriage by means of parallelogram arms 84 and 86. Each of the arms 84, 86 is pivotably supported at its ends. A cylinder 88 has its lower end pivotably connected to the bracket plates 92 and 94 so that the lower end of the cylinder may pivot about pin 90. See FIGS. 1 and 3.

Figure 2:
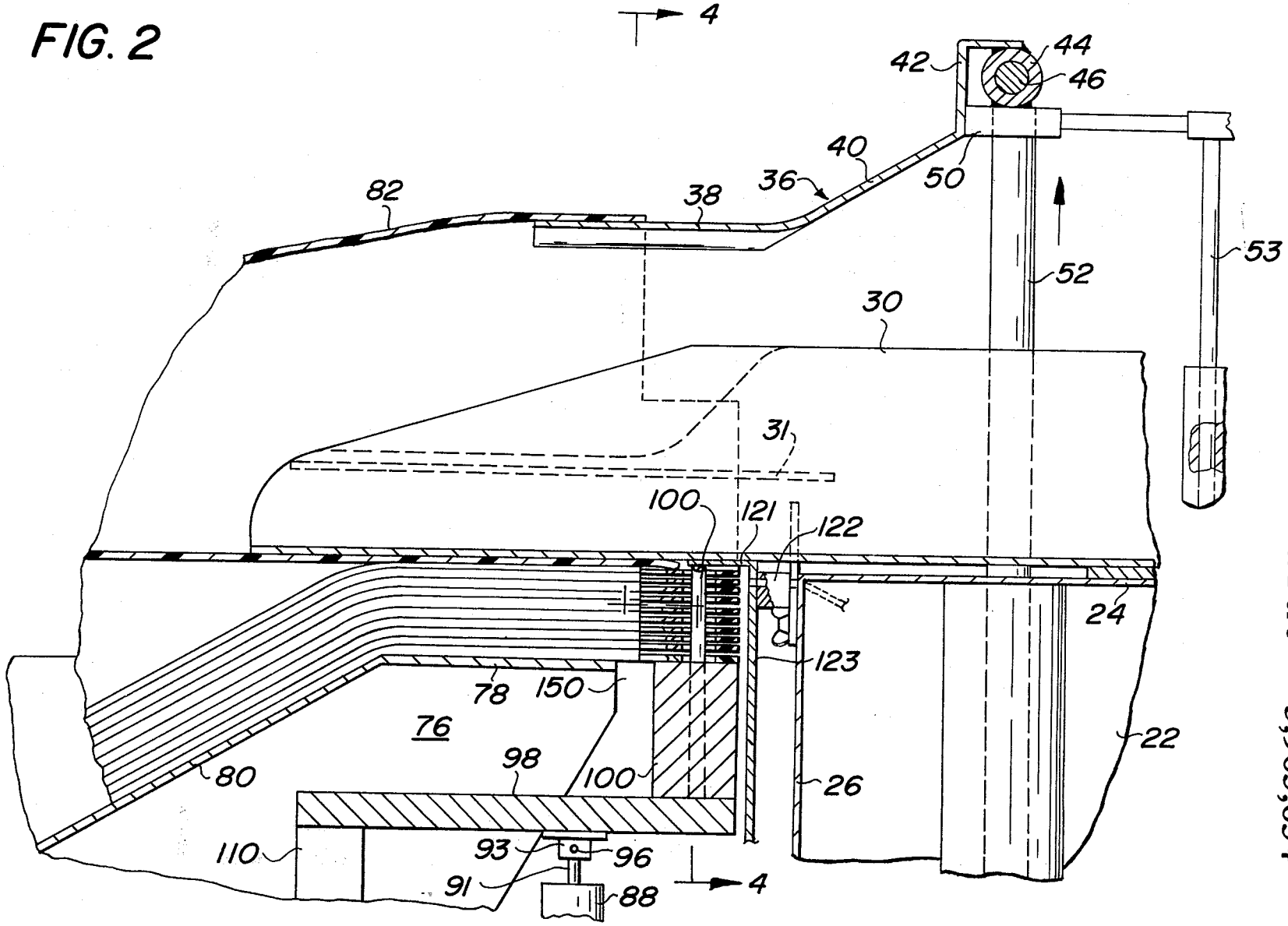
FIG. 2 is an enlarged detail view, partly in section, of the bagging carriage in a bagging position.

A horizontally disposed bail mount plate 98 is provided as shown in FIGS. 1 and 2. A piston rod 91 associated with cylinder 88 has its upper end pivotably connected to the bail mount plate 98 for rotation about the axis of pin 96. Cross bar 93 extends between and is supported by the side plates 74, 76. The end of plate 98 adjacent the wall 26 is provided with a bail support 100 for supporting U-shaped bail 102. The bail 102 may be in the form of spaced pins but preferably is as shown in the form of a U-shaped inverted bail.

Parallel shafts 104 and 106 are rotatably supported by the side plates 74, 76, and rotatably support one of each of the parallelogram arms 84, 86. The end of the bail mount plate 98 remote from the wall 26 is supported by vertically disposed braces 108 and 110. As shown more clearly in FIG. 3, the shafts 104 and 106 extend through the braces 108, 110 and are rotatable with respect to the same.

A nozzle 122 having a bag limit stop 121 is supported by a plate 123 from the vertically disposed portion 66. The plate 123 is supported by a bolt 125 with a spring 127 biasing the plate to the vertical position shown. A nut on bolt 125 is disposed between the portion 66 and plate 123 and facilitates moving the position of the nozzle 122 and its support plate 123 horizontally toward and away from the vertically disposed portion 66. The spring 127 permits plate 123 to tilt, thereby moving limit stop 121 out of the way, to facilitate loading of bags on the carriage.

Figure 6:
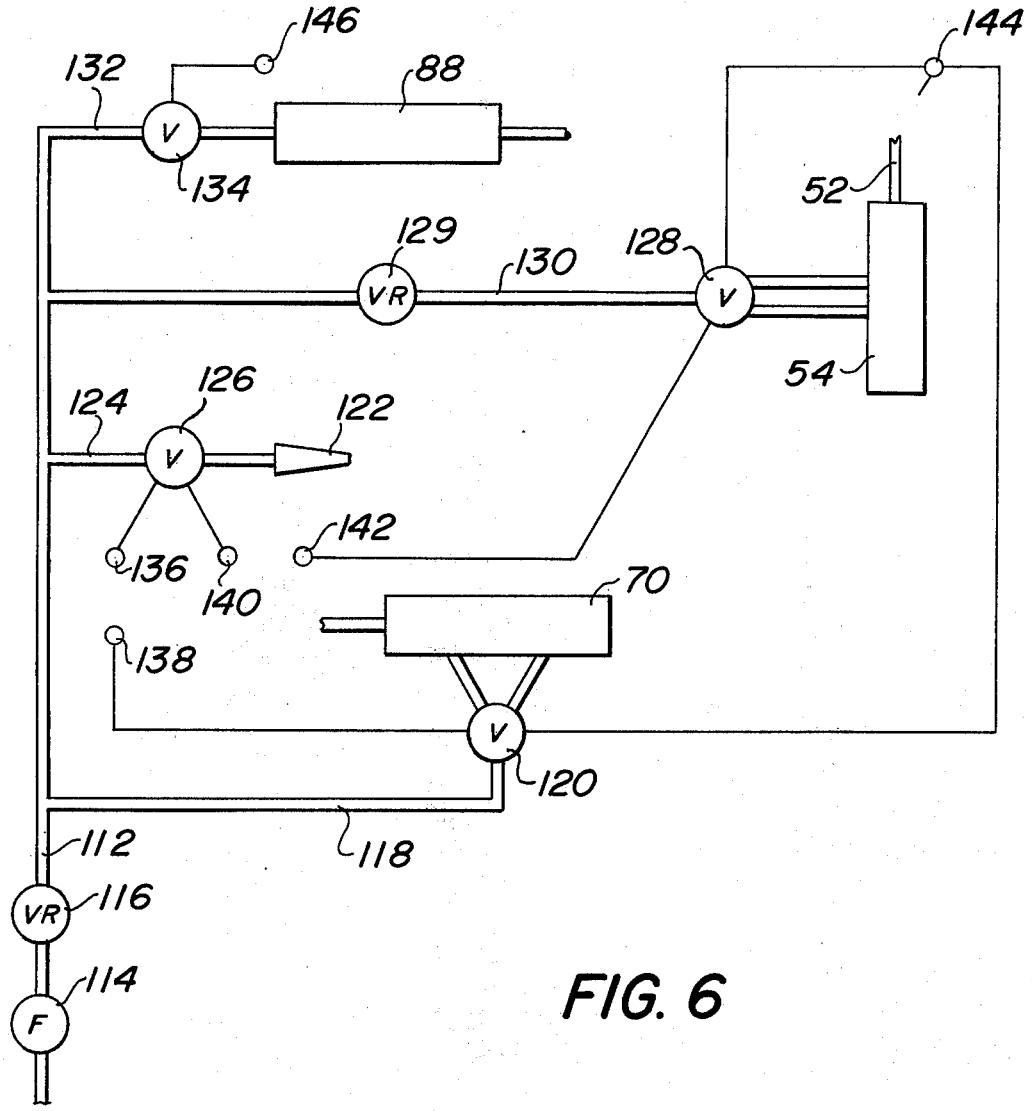
FIG. 6 is a diagrammatic illustration of circuitry.

In FIG. 6 there is diagramatically illustrated circuitry which is disposed in or on the housing 12. Conduit 112 is connected to a source of pressurized air and contains a filter 114 and a pressure regulating valve 116.

The cylinder 74 reciprocating the carriage is provided with a supply and exhaust valve 120 connected to the conduit 112 by way of conduit 118. The air nozzle 122 is connected to the conduit 112 by way of conduit 124 containing an on-off valve 126.

The cylinder 54 for elevating the horn 36 is provided with a supply and exhaust valve 128 connected to the conduit 112 by way of conduit 130. The cylinder 88 is connected to the conduit 112 by conduit 132 containing a supply and exhaust valve 134.

The operation of the apparatus 10 is as follows. Assume there is a stock of bags 82 on the carriage as illustrated in FIG. 1. Also, assume that the carriage is moving from right to left in FIG. 1. When the carriage reaches the end of its stroke, it trips microswitches 136 and 138. Microswitch 136 opens valve 126 so that air discharges from the nozzle 122. Microswitch 138 reverses valve 120 so that the carriage is then moved from left to right in FIG. 1.

As the carriage moves from left to right in FIG. 1, the uppermost bag 82 is blown open by air from the nozzle 122. The open bag embraces the horns 30 and 36 as the carriage and the bag support move below the horn 30. As the carriage vertically disposed portion 66 approaches the wall 26, the carriage reaches the end of its stroke. Immediately prior to reaching the end of the carriage stroke, it trips the microswitch 140 which closes valve 126 and immediately thereafter trips microswitch 142. When the carriage reaches the end of its stroke, it dwells there until recycled as described below.

The tripping of microswitch 142 operates valve 128 so that piston rod 52 is moved upwardly to elevate the horn 36. As the horn 36 is elevated, it stretches the bag 82. The mouth of the bag 82 is stretched and thereby limits further upward movement of the horn 36. When using a 1.5 mil bag 82 having a 14½ inch circumference, the bag is stretched to about 16 inches. The amount of stretch desired as well as the pressure needed will vary with bag wall thickness, the material of the bag, etc. Variable regulator 129 in conduit 130 permits the pressure in cylinder 54 to be selectively varied.

Thereafter, the operator introduces the object, such as a frozen chicken, frozen turkey, ham, etc. into the bag by pushing it along the upper surface of the horn 30. The object may rest on the horn 30 to the right of the arm 50 in FIG. 1. The horn 30 is substantially longer than the horn 36 to facilitate supporting the object in a position where it may be pushed into the bag 82.

As the object is pushed into the bag 82, the operator also strips the bag 82 and the object off the horns 30, 36. Such stripping action releases the horn 36 so that it may continue to be moved upwardly by piston rod 52 until it trips microswitch 144. Also, the bag constricts about the object to provide a tight packaging comparable to a shrink fit.

When microswitch 144 is tripped, it reverses valve 128 so as to cause the arm 50 to descend to the position shown in FIG. 1. At the same time, microswitch 144 reverses valve 120 so as to terminate the dwell of the carriage and commence a new stroke from right to left in FIG. 1. As mentioned above, the carriage as illustrated in FIG. 1 is moving and is approaching the end of its stroke remote from the wall 26. While the carriage is being recycled and the horn 36 is descending, the operator applies a tie, clip, or otherwise seals the bag. The sequency of events is then repeated whereby the apparatus 10 is automatically recycled.

As the bags are consumed, the support plate 98 is elevated by the pressure in cylinder 88 so that the uppermost bag contacts limit stop 121. When the stack of bags 82 is substantially depleted, one of the side plates 74, 76 trips microswitch 146. When microswitch 146 is tripped, it operates valve 134 to vent the cylinder 88 to atmosphere thereby causing the bag support to descent to its lowermost position. As shown in FIG. 1, the plates 74, 76 are in a generally middle position. Limit switch 146 also controls the regulator valve 116 or some other valve in conduit 112 to shut off the supply of air. When a new stack of bags 82 has been applied, the supply of air is manually turned on and the cycle is permitted to then repeat.

To facilitate stripping the bag 82 from the bail 102, the tab 83 is provided with holes to receive the bail prongs and is provided with slits directed from an edge toward the holes in a manner which per se is well known to those skilled in the art. If no bag is telescoped over the horns 30, 36, horn 36 will be cycled up to trip limit switch 144 to repeat the cycle as described above. If an operator has his hand under the horn 36 when horn 36 descends, horn 36 pivots upwardly about the axis of rod 46 by such contact whereby the operator is not injured.

The tube or rod 31 is prevents the bag 82 from contacting the outer entire surface of horn 30 thereby providing a longitudinally extending vent passage. When the object was stuffed into the bag, the air in front of the object was not compressed but instead was vented to atmosphere via said vent passage. Sanitary conditions do not permit providing the bag with a vent hole for accomplishing such venting.

The only surfaces of the apparatus 10 which come in contact with food are the horns 30 and 36. Gap 160 interrupts the surface so as to prevent collection of water when the apparatus is cleaned. The horns 30 and 36 are readily detachable and are preferably made from stainless steel so that they may be sterilized or steam cleaned. Preferably, none of the parts of the apparatus 10 are coated, plated or painted. The cylinders, the legs for the housing 12, and plate 98 may be made from aluminum. The remainder of the components are preferably stainless steel except for bearings which are preferably nylon.

The present invention may be embodied in other specific forms without departing from the spirit or essential attributes thereof and, accordingly, reference should be made to the appended claims, rather than to the foregoing specification as indicating the scope of the invention.

We claim:

1. Bagging apparatus comprising a support structure, first and second horns mounted on said support structure, said second horn being shorter than said first horn, means connected to said second horn for moving said second horn toward and away from said first horn, a carriage supported by said support structure for movement toward and away from said horns, a portion of said carriage being below said first horn at one end of its movement, means on said carriage for supporting a stack of bags and for elevating the stack of bags, means including circuitry connected to said second horn and carriage for automatically cycling the same so that the carriage movement toward said horns causes the top bag to at least partially telescope over a portion of the horns and then causes the second horn to move away from the first horn to stretch the mouth of the bag, and means for causing the top bag to be open during such movement of the carriage toward the horns.

2. Apparatus in accordance with claim 1 wherein said second horn is disposed above said first horn, the leading edge of said second horn being spaced axially rearwardly from the leading edge of said first horn, said first horn being stationary and concave upwardly, said second horn being concave downwardly.

3. Apparatus in accordance with claim 1 wherein said circuitry includes a pneumatic cylinder for moving said second horn, a pneumatic cylinder for reciprocating said carriage, a common supply conduit for said cylinders, and said means for causing the bag to open including the nozzle supported by the carriage and connected to said common supply conduit.

4. apparatus in accordance with claim 1 including a microswitch positioned for tripping by an element movable with said second horn after a bag has been stripped off the horns, said microswitch being part of said circuitry and coupled in a manner so as to initiate recycling of the carriage and for causing the second horn to move toward the first horn.

5. Apparatus in accordance with claim 1 wherein said horns, carriage and support structure are made of stainless steel, said support structure being a housing containing said circuitry.

6. Bagging apparatus comprising a support structure, first and second horns mounted on said support structure, said first horn being concave upwardly, said second horn being disposed above said first horn and being concave downwardly, means connected to said second horn for reciprocating said second horn toward and away from said first horn, a carriage supported on said support structure for reciprocation at an elevation below the elevation of said first horn, the leading edge portion of said first horn being disposed immediately above said carriage at one end of the stroke of said carriage, means on said carriage for supporting a stack of bags, means connected to said carriage for reciprocating said carriage, nozzle means for directing a stream of air toward an open mouth on the uppermost bag for opening the uppermost bag as the carriage moves toward said one end of its stroke so that the open bag telescopes over the leading edge portion of said horns, means including circuitry for causing said second horn to move away from said first horn when said carriage reaches the said end of its stroke to thereby stretch the mouth of a bag, and means for causing a dwell of said carriage movement at said one end of said stroke to provide sufficient time so that an article may be introduced into a bag being stretched by said horns.

7. Apparatus in accordance with claim 6 wherein said first horn is longer than said second horn, said second horn having a leading edge spaced axially from the leading edge of said first horn, the trailing edge of said second horn being supported by an arm forming a part of said means connected to said second horn for moving said second horn.

8. Apparatus in accordance with claim 7 including means on the carriage for elevating said bag support means in a predetermined manner so that the top bag of a stack of bags is always in a position to be telescoped over said horns as said carriage approaches said one end of its stroke.

9. Bagging apparatus comprising a support structure, first and second horns removably mounted on said support structure, means connected to said second horn for moving the leading edge of said second horn toward and away from said first horn, a carriage supported by said support structure for reciprocable movement toward and away from a position wherein said carriage is below said horns at one end of its movement, means on said carriage for supporting a stack of bags and for elevating the stack of bags, means including circuitry connected to said second horn and carriage for automatically cycling the same so that the carriage movement towards said horns causes the top bag to partially telescope over a leading edge portion of the horns and then causes the second horn leading edge portion to move away from the first horn to stretch the mouth of the bag, and air nozzle means movable with said carriage for causing the top bag to open during such movement of the carriage toward the horns.

10. Apparatus in accordance with claim 9 wherein said second horn is disposed above said first horn, the leading edge of said second horn being spaced axially rearwardly from the leading edge of said first horn, said first horn being stationary and concave upwardly, said second horn being concave downwardly, said circuitry including a pneumatic cylinder for moving said second horn, a pneumatic cylinder for reciprocating said carriage, a common supply conduit for said cylinders, and said nozzle means for causing the bag to open including an air nozzle supprted by the carriage and connected to said common supply conduit.

11. Apparatus in accordance with claim 9 including means on one of said horns for creating an air vent passage for venting the space between an object being stuffed into a bag and the closed end of bag.

12. Apparatus in accordance with claim 9 wherein said second horn is mounted for pivotable movement in an upward direction.

* * * * *